US010351778B2

(12) United States Patent
Iqbal

(10) Patent No.: US 10,351,778 B2
(45) Date of Patent: Jul. 16, 2019

(54) SYSTEMS FOR PRODUCING ANODE GRADE COKE FROM HIGH SULFUR CRUDE OILS

(71) Applicant: KELLOGG BROWN & ROOT LLC, Houston, TX (US)

(72) Inventor: Rashid Iqbal, Houston, TX (US)

(73) Assignee: Kellogg Brown & Root LLC, Houston, TX (US)

( * ) Notice: Subject to any disclaimer, the term of this patent is extended or adjusted under 35 U.S.C. 154(b) by 45 days.

(21) Appl. No.: 15/603,224

(22) Filed: May 23, 2017

(65) Prior Publication Data

US 2017/0335199 A1 Nov. 23, 2017

Related U.S. Application Data

(60) Provisional application No. 62/340,172, filed on May 23, 2016.

(51) Int. Cl.
*C10B 55/00* (2006.01)
*C10B 3/00* (2006.01)

(52) U.S. Cl.
CPC ..... *C10B 55/00* (2013.01); *C10B 3/00* (2013.01)

(58) Field of Classification Search
CPC ..... C10B 55/00; C10B 3/00
See application file for complete search history.

(56) References Cited

U.S. PATENT DOCUMENTS 4,676,886 A * 6/1987 Rahbe ..... C10B 55/00 208/131
6,332,975 B1 * 12/2001 Abdel-Halim ..... C10G 55/04 208/131
2011/0005912 A1 * 1/2011 Sabottke ..... C10B 55/00 201/20
2011/0094937 A1 4/2011 Subramanian et al.
2015/0008157 A1 1/2015 Smiley et al.

OTHER PUBLICATIONS

Motaghi, Mitra, et al., "Anode-Grade Coke from Traditional Crudes," www.eptq.com, PTQ, Q2, 2010, pp. 15-18.

* cited by examiner

*Primary Examiner* — Randy Boyer
*Assistant Examiner* — Juan C Valencia
(74) *Attorney, Agent, or Firm* — Gary Machetta

(57) ABSTRACT

Methods and systems for producing anode grade coke are disclosed, which allow anode grade coke to be produced from crude oil having a high sulfur content. A fraction of the resid is hydrotreated while another fraction of the resid is treated in a solvent deasphalting unit. A synthetic stream is provided by blending hydrotreated resid with one or more streams from the deasphalting unit. The synthetic stream is fed to an anodic coker unit.

19 Claims, 3 Drawing Sheets

Table 2

| | 301 | 302 | 303 | 304 | 305 | 306 | 307 | 308 (Klb / Day) |
|---|---|---|---|---|---|---|---|---|
| Arab Heavy Crude | 24.1 | 13.2 | 1.3 | 11.9 | 20.6 | 9.2 | 2.7 | 1215 |
| Arab Medium Crude | 22.9 | 13.0 | 2.6 | 10.4 | 19.6 | 8.1 | 2.3 | 1125 |
| Arab Light Crude | 10.5 | 11.1 | 0 | 11.1 | 9.2 | 8.7 | 2.5 | 474 |
| Arab Light Crude* | 12.6 | 10.4 | 2.6 | 7.8 | 11.1 | 6.1 | 1.7 | 621 |

SYSTEMS FOR PRODUCING ANODE GRADE COKE FROM HIGH SULFUR CRUDE OILS

CROSS REFERENCE TO RELATED APPLICATION

This application claims priority to U.S. Provisional Patent Application having Ser. No. 62/340,172 filed on May 23, 2016, which is incorporated by reference herein.

FIELD OF THE INVENTION

The present invention relates generally to the field of refining and more particularly to methods for making anode grade coke from crude oil with high levels of sulfur.

BACKGROUND

Crude oil is a complex mixture of thousands of chemical species, most of which are hydrocarbons, i.e., they are made of carbon and hydrogen. Some chemical species in crude oil contain other elements (referred to as "hetero elements"), such as sulfur, nitrogen, or metals such as vanadium or nickel. Crude oils from different locations on the earth have vastly different composition; the types and relative amounts of compounds they contain can vary greatly. For example, "heavy" crude oils contain a relatively higher amount of large hydrocarbon molecules whereas "light" crude oil contains a relatively higher amount of small hydrocarbon molecules. "Sweet" crude oil contains little sulfur (typically less than about 0.5 weight percent) whereas "sour" crude oil contains a higher amount of sulfur (typically 1-2 weight percent or more).

Crude oil itself is generally not very useful; it must be refined and processed to yield valuable products. Refining and processing involves subjecting the crude oil to various separations and chemical reactions that ultimately yield a spectrum of useful products such as transportation fuels (aviation gasoline, automobile gasoline, and diesel fuel), heating oil, and kerosene, asphalt and petroleum coke.

The highest value products, such as transportation fuels, are typically obtained in the highest quantities and with the least effort from light sweet crude oils. However, light sweet crude oil sells at a premium because of its desirability. The high price of light sweet crude oil has incentivized efforts to obtain valuable petroleum products from lower grades of crude oil, i.e., heavier crude oil having more sulfur and metals. Such crude oils require more complex refining and processing.

Petroleum coke (also referred to as petcoke and referred to herein simply as coke) is a high carbon product of petroleum refining. Coke is obtained by heating the heavy residue left over from distillation processes (also referred to as resid) in the presence of steam to produce a solid, carbonaceous material. The marketability of coke depends on the amount of sulfur it contains. Coke with a relatively high sulfur content is referred to as fuel grade coke and is sold as fuel for coal-burning boilers, typically for power generation. Coke with a relatively low sulfur content can be used to make electrodes that are valuable for use in dry cells and in industrial electrical process, such as the production of aluminum.

Anode grade coke generally must have a sulfur content less than 3 weight percent, a nickel content less than 200 ppm, a vanadium content less than 350 ppm and a total metals content less than 500 ppm. In addition to heteroatom content, anode grade coke is subject to other constraints. For example, anode grade coke that is suitable for making carbon anodes suitable for aluminum manufacture preferably has an HGI grindability index greater than 70, a bulk density of at least 50 lbs/ft$^3$, and a volatile carbonaceous material content of less than 10 or 12 weight percent. It is more desirable to produce anode grade coke since this is a higher value product than fuel grade coke. Anode grade coke is about three to five times more valuable than fuel coke.

The quality of crude oil that a refining process uses as a feedstock largely determines the grade of coke obtained from the process. Light sweet crude produces a higher yield of anode grade coke. However, as economic forces drive refiners to using heavier and more sour crude, anode grade coke is more difficult to obtain. The distillation of the crude tends to concentrate sulfur and other contaminants into the resid.

Hydroprocessing generally refers to hydrotreating and hydrocracking processes. Hydroprocessing is a method of improving the quality of distillate products and occasionally treating residues from distillation processes. Hydroprocessing involves reacting the distillate products and at times residue from distillation with hydrogen in the presence of a catalyst to remove sulfur. Hydrocracking is used to convert the high boiling distillates and at times petroleum residue into a higher proportion of more valuable lower-boiling products. The residue remaining after the lower-boiling products are removed from the hydroprocessing unit effluent generally has a lower sulfur and metal content.

It has been suggested to hydrotreat the distillate residues obtained from high sulfur crude to remove the sulfur and provide a higher grade of coke. Unfortunately, hydrotreating of the petroleum residue affects the physical characteristics of the resulting resid, rendering it unsuitable for the anode manufacturing process. Therefore, for the production of anode grade coke, feedstocks have been historically limited to virgin residues with inherently low sulfur and metals content.

There is a need, therefore, for improved methods of processing lower grade crude to obtain higher amounts of valuable products, such as anode-grade coke.

DETAILED DESCRIPTION

Figure 1:
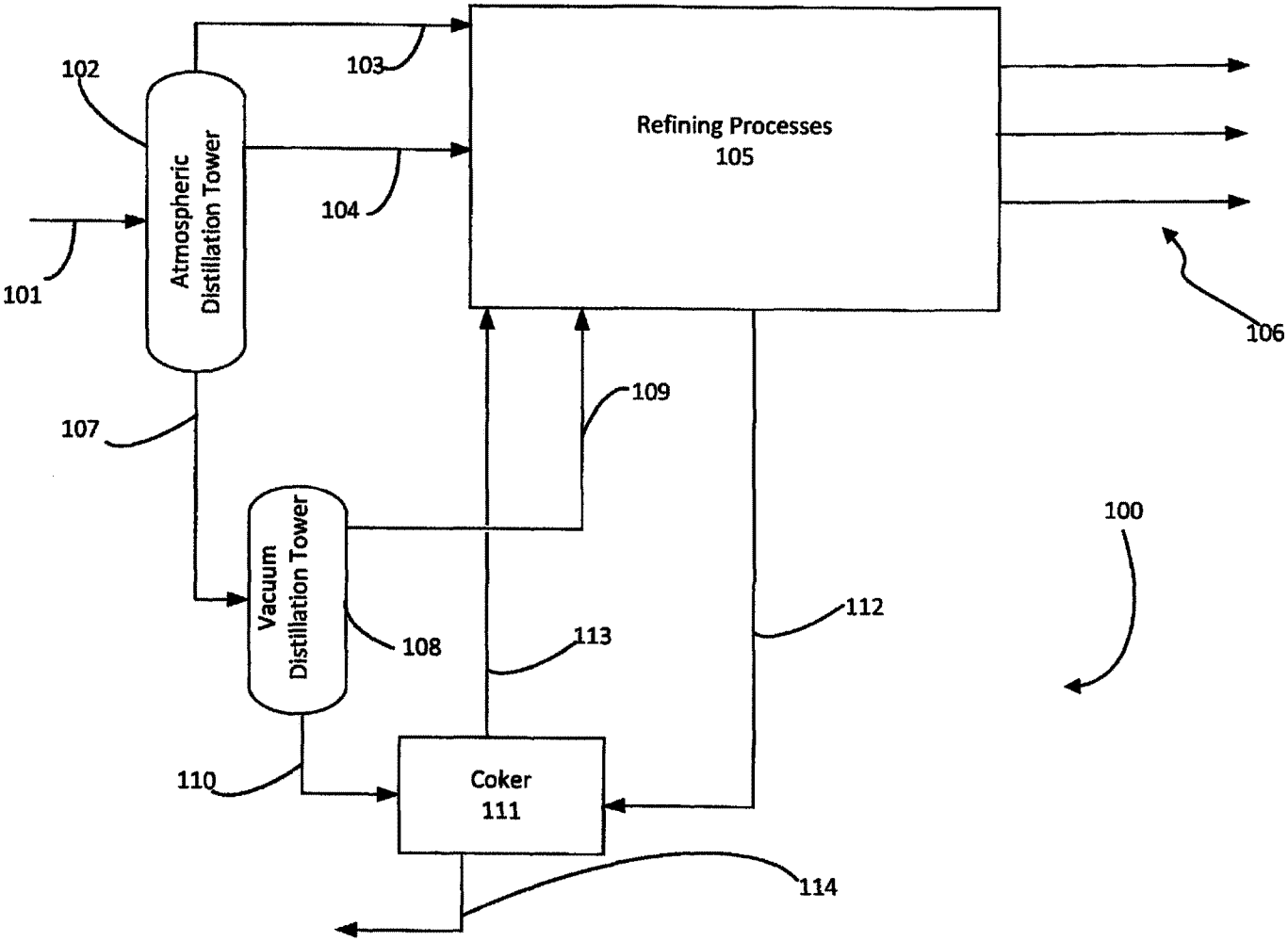
FIG. 1 (PRIOR ART)
FIG. 1 illustrates a generic refining process, as known in the prior art.

FIG. 1 illustrates a simplified generic refining process 100 according to the prior art. A crude oil feed stream 101 enters an atmospheric distillation tower 102. Atmospheric distillation produces an overhead stream 103 comprising gas components and one or more light liquid streams 104 comprising components such as naphtha, kerosene, and gas oil. The streams 103 and 104 from the atmospheric distillation tower feed into further refining processes 105 to produce a range of products 106. The further refining processes 105 are not particularly relevant in the instant disclosure and are not discussed further. The bottom stream 107 from the atmospheric distillation tower feeds into a vacuum distillation tower 108. Distillates exit the vacuum distillation tower 108 via one or more streams 109 for further refining. The bottom stream 110 of the vacuum distillation tower 108 feeds into a coker or a coking unit 111. The bottom stream 110 generally contains large concentrations of resins asphaltenes and heteroatom compounds such as compounds containing sulfur, nitrogen, oxygen and metals. Heavy streams 112 from other processes can feed into the coking unit 111 for further process. Coking results in one or more products such as naphtha, light oil, or heavy oil, which exit the coking unit 111 via stream 113. Coke exits the coking unit 111 via stream 114.

As explained above, the coke produced by the coking unit 111 is preferably low in sulfur content for the coke to be useful as anode materials. When the crude feedstock 101 has a high sulfur content, the resulting coke generally also has a high sulfur content, rendering it unsuitable as an anode material. The coke thus produced therefore is not as valuable.

Figure 2:
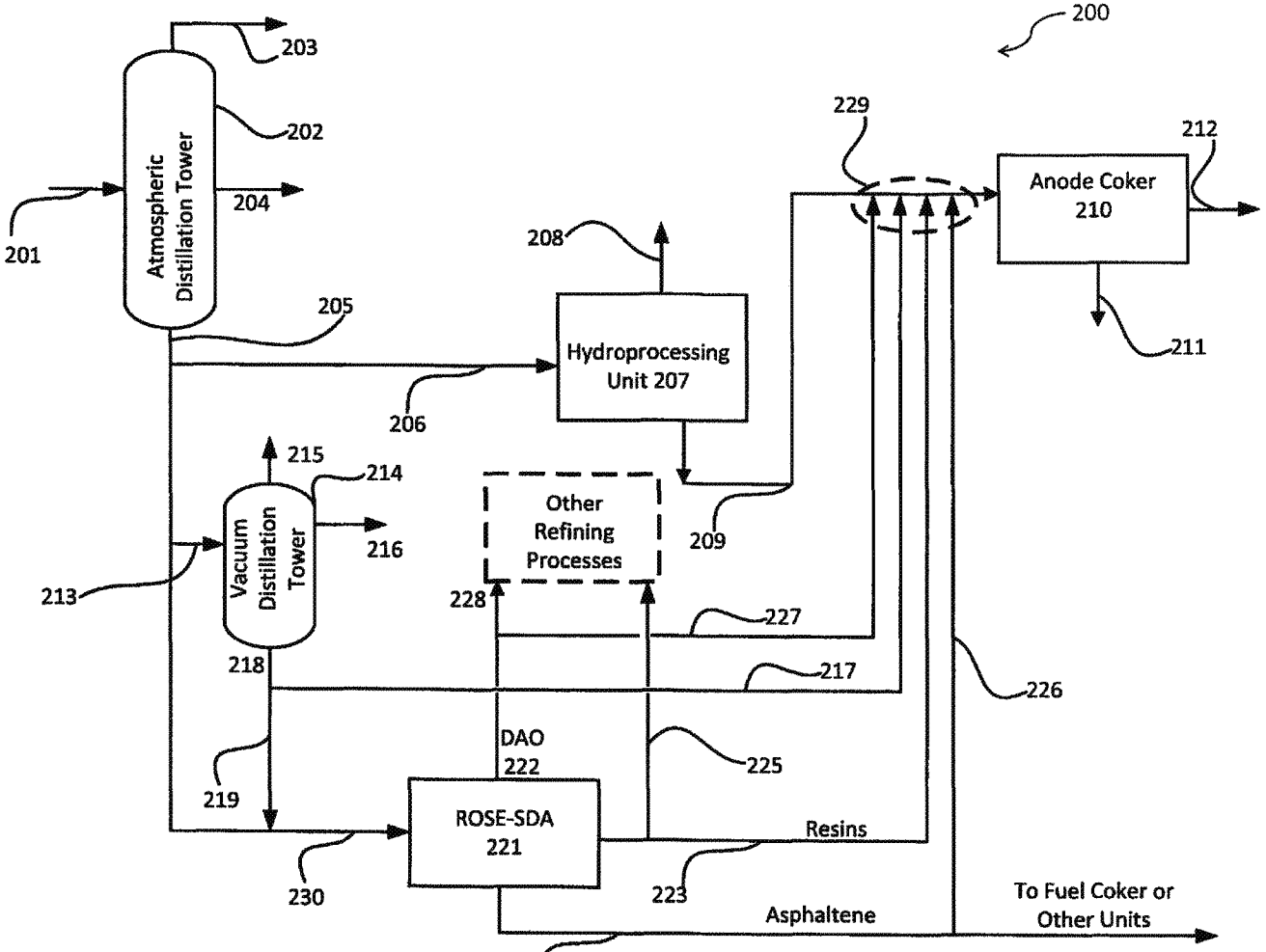
FIG. 2 depicts a refining process including a hydrotreating unit and a ROSE-SDA for providing a synthetic product stream to an anodic coking unit.

FIG. 2 illustrates an embodiment 200 of the process disclosed herein for producing anode grade coke from high sulfur crude oils. A stream of high sulfur crude 201 enters an atmospheric distillation tower 202 and is separated into an overhead stream 203 (typically liquefied petroleum gas, LPG), one or more mid-distillate product streams 204, and an atmospheric distillation tower bottoms stream 205 which includes mostly resid. A portion 206 of the atmospheric distillation tower bottoms stream 205 feeds into a hydroprocessing unit or a hydrotreating unit 207.

Sulfur removal by hydroprocessing (hydrotreating and/or hydrocracking) is well known in the art. The hydroprocessing unit 207 can generally be any type of hydrogen addition unit known in the art, for example, a Fixed bed unit, a slurry-phase unit, or an ebullated bed unit. Hydroprocessing unit 207 may be a once through unit, a single stage recycle, or a multi-stage unit. The hydroprocessing process may use one or more of multiple commonly used catalysts using Nickel, Cobalt, Molybdenum, or noble metals.

The hydroprocessing unit 207 produces one or more product streams 208 (typically containing jet fuel, diesel, low sulfur fuel oil (LSFO), and/or naphtha) and bottoms stream 209 (typically containing desulfurized resid). The hydroprocessing unit bottoms stream 209 (also referred to as hydrotreated resid) is provided to an anode coking unit 210. The anode coking unit 210 can generally be any type of coking unit known in the art, but is typically a delayed coking unit. The anode coking unit 210 may include one or more pairs of drums, for example, one pair, two pairs, three pairs, four pairs, or more, as is known in the art. The anode coking unit 210 produces low sulfur anode-grade coke (stream 211) and one or more product streams 212 (containing products such as naphtha and light and heavy coker gas oils).

A second portion 213 of the atmospheric distillation tower bottoms stream 205 feeds into a vacuum distillation tower 214, where it is separated into a vacuum tower overhead stream 215 (LPG), one or more mid-distillate streams 216 (heavy and/or light vacuum gas oil, gasoline), and a vacuum distillation tower bottoms stream 218 (resid). A portion 217 of the vacuum distillation tower bottoms 218 can be blended with the stream 209 from the hydroprocessing unit 207 and fed to the anode coker 210. Another portion 219 of the vacuum distillation tower bottoms stream 218 can be blended with the atmospheric distillation tower bottoms stream 205 to provide a feed 230 to a solvent deasphalting unit 221. The solvent deasphalting unit 221 may be a three-product solvent deasphalting unit such as a three-product residuum oil supercritical extraction-solvent deasphalting (ROSE-SDA) unit.

ROSE-SDA is described in US 2011/0094937 ("the '937 publication"). According to certain embodiments, a three-product ROSE-SDA unit, as illustrated in FIG. 2 of the '937 publication and described at paragraphs [0066]-[0085] of the '937 publication (the referenced contents of which are hereby incorporated herein by reference), is used for solvent deasphalting.

In the embodiment illustrated in FIG. 2, feed 230 to the deasphalting unit 221 includes a portion of the atmospheric distillation tower bottoms stream 205 and a portion 219 of the vacuum distillation tower bottoms stream 218. It should be noted, however, that in other embodiments, the feed 230 to the solvent deasphalting unit may include only one or the other of streams 205 and 218.

The solvent deasphalting unit 221 produces a top stream 222 (containing deasphalted oil a.k.a. light deasphalted oil, (L-DAO)), one or more streams 223 (containing heavy deasphalted oil (H-DAO), a.k.a., resin), and a bottom stream 224 (primarily containing asphaltenes). According to some embodiments, a portion 225 of stream 223 (resin) and/or a portion 228 of stream 222 (L-DAO) can be routed to other processes within the refinery for blending or other further processing. It should be noted that one such other processes can include hydroprocessing, such as by hydrotreating and or hydrocracking unit(s) 207.

A portion of stream 223 (resin), a portion 226 stream 224 (asphaltenes), and/or a portion 227 of stream 222 (L-DAO) can be blended with the hydroprocessing unit product stream 209 to produce a synthetic stream 229 as feed to the anode coking unit 210. The specific composition of stream 229 can be adjusted to 1) provide adequate quality material for making anode-grade coke, while 2) optimizing the economics of the upstream processes (i.e., energy use, catalyst use and lifetime, yield of high value products, etc.).

The availability of multiple streams of processed tower bottoms for anode coking overcomes several of the difficulties mentioned in the Background section. As described in the Background section, the feedstock for producing anode grade coke must be low in sulfur and metals content. Hydrotreating a portion of the atmospheric distillation tower bottoms stream (portion 206 in FIG. 2) can provide a stream 209 that is well within the sulfur and metals concentration tolerances for anode coking as well as providing an overhead stream 208 of lighter, more valuable components. However, as mentioned above, hydrotreated resid generally yields coke not meeting the physical specifications (an HGI grindablility index greater than 70, a bulk density of at least 50 lbs/ft$^3$, and a volatile carbonaceous material content of less than 10 or 12 weight percent) for anode grade coke.

Another drawback of hydroprocessing residual oil to remove sulfur and metals is that it is a severe process, requiring intensive hydrogenation (using large amounts of hydrogen), a great amount of energy, frequent catalyst replacement. Relying on hydroprocessing of atmospheric distillation tower bottoms and vacuum distillation tower bottoms as the sole source of the feedstock for the coking unit is prohibitively expensive.

The process 200 illustrated in FIG. 2 does not suffer from those drawbacks because the hydroprocessing unit is not used to remove sulfur and heavy metals from the entire resid feedstock for the anodic coking unit. Instead, process 200 provides multiple resid streams that can be blended into a feed 229 for the anodic coking unit. Each of the streams can have different sulfur and heavy metals concentrations. Each of the streams also may have a different cost associated with producing that stream.

For example, stream 209 has a very low sulfur and metals content but is also relatively expensive to produce, due to the costs associated with operating the hydroprocessing unit. Likewise, the amount of sulfur and metals in stream 217 may exceed the amount specified for feed to the anodic coker, but stream 217 is much less expensive to produce than stream 209 (on a barrel per day basis). By blending streams 209 and 217 together, it may be possible to produce a stream that is both within specification for anodic coking unit and is also economically feasible. Generally, stream 209 has the lowest sulfur/metal concentration but is the most expensive and stream 217 has the highest sulfur/metal concentration but is the least expensive. Streams 227, 223, and 226 are intermediate in both costs and sulfur content.

Reducing the resid-treating demand of the hydroprocessing unit 207 allows the unit to be operated more economically without bottlenecking the resid-treating process. Since the hydroprocessing unit 207 has less resid to treat, it can be operated under less severe conditions and uses less hydrogen and catalyst. Catalyst lifetimes can be extended. Moreover, the hydroprocessing unit 207 (which typically must be made of specialized and expensive metallurgical materials) can be smaller (and therefore less costly to build).

Figure 3:
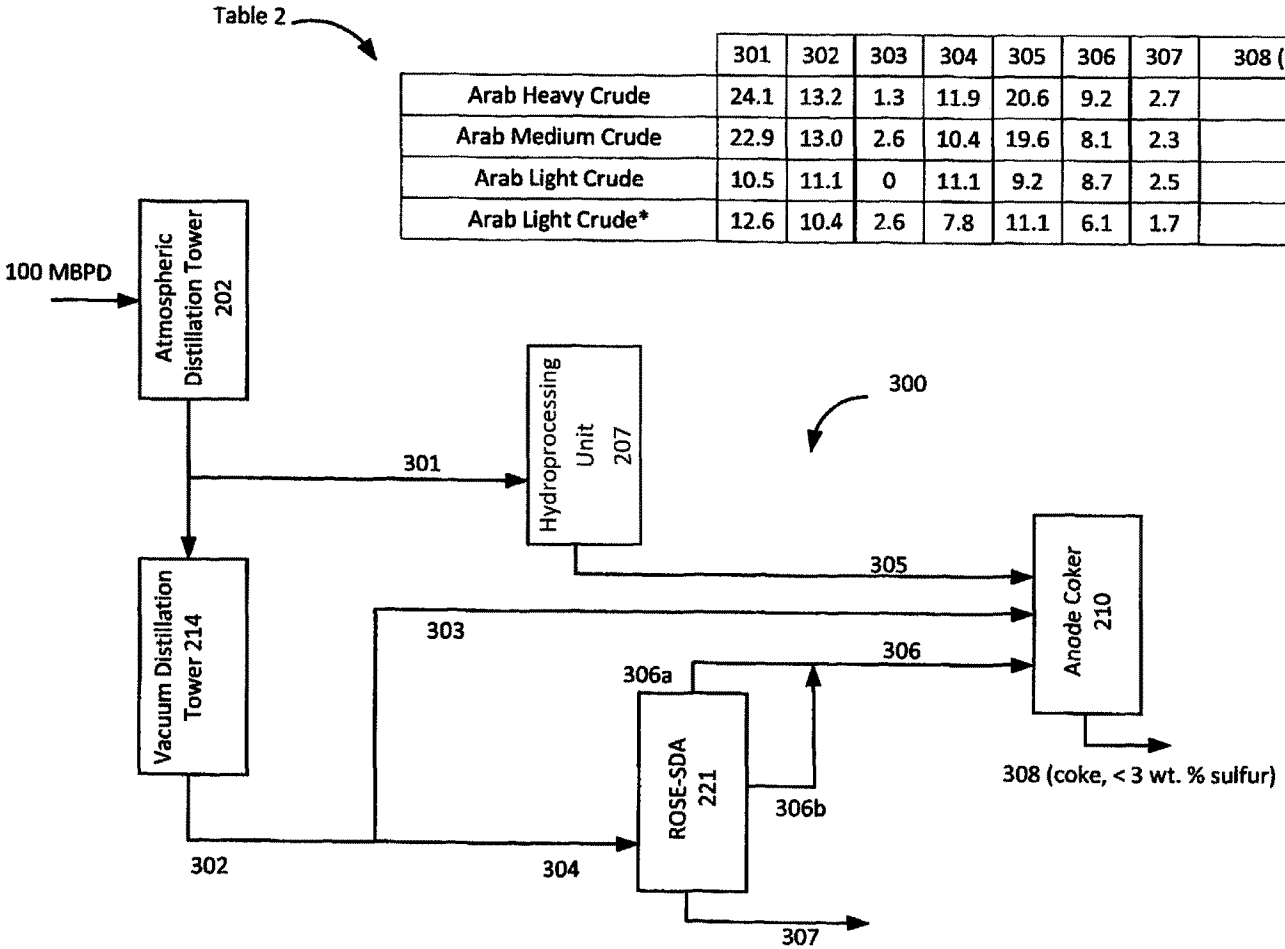
FIG. 3 depicts a schematic illustration of a process as illustrated in FIG. 2 operated under four different conditions.

The process 200 described above is re-illustrated as a more simplified schematic 300 in FIG. 3 for providing relative amounts of material in the various streams in the process. For clarity, several of the overhead streams illustrated in FIG. 2 are omitted in FIG. 3. Based on a crude feed of 100,000 barrels per day (100 MBPD), the following are typical ranges for the amounts of material in each of the streams: 5-35 MBPD in stream 301; 5-30 MBPD in stream 302; 0-15 MBPD in stream 301 5-30 MBPD in stream 304; 2-25 MBPD in stream 305; 1.5-20 MBPD in stream 306 (typically with a 1.5-20 MBPD contribution of deasphalted oil via stream 306*a* and a 0-15 MBPD contribution of resin via stream 306*b*); 2-25 MBPD in stream 307 and 2-20 MBPD in stream 308.

A person of skill in the art will recognize that the relative amounts of material in each stream can be adjusted depending on the various considerations, including the amount of sulfur in the crude reed material. Table 1 lists the approximate amount of sulfur in three trades of Arab Crude Oil:

TABLE 1

Sulfur Content of Various Grades of Arab Crude Oil.

| Grade | Sulfur (%) |
|---|---|
| Arab Light | 1.97 |
| Arab Medium | 2.59 |
| Arab Heavy | 2.87 |

Note that the amount of sulfur in each of the grades of Arab Crude Oil becomes much more concentrated in the residues from the atmospheric distillation tower and the vacuum distillation tower.

Table 2, illustrated in FIG. 3, lists the amount of material directed through each of the streams of process 300 under various operating conditions. Column 308 of Table 2 lists the amount (in KLb/Day) of anodic coke produced by anode coking unit 210 under each of the operating conditions. The relative amounts of materials in streams 301 and 304 are greater for the Arab Heavy Crude than for the other grades of crude. Arab Heavy Crude contains more sulfur and therefore requires more hydrotreating and/or solvent deasphalting to yield anodic coke.

Another notable observation from Table 2 is the increased anodic coke yield when vacuum distillation tower residue is mixed into the anodic coking unit feed stream. In the first example of processing Arab Light Crude, no vacuum tower residue is fed directly to the anodic coking unit (i.e., no material is provided via stream 303). That processing operation yields 474 KLb/day of anodic coke. But when 2.6 MBPD of vacuum tower residue is fed to the anodic coking unit, the production of anodic coke increases to 621 KLb/day.

Certain embodiments and features have been described using a set of numerical upper limits and a set of numerical lower limits. It should be appreciated that ranges including the combination of any two values, e.g., the combination of any lower value with any upper value, the combination of any two lower values, and/or the combination of any two upper values are contemplated unless otherwise indicated. Certain lower limits, upper limits, and ranges appear in one or more claims below. All numerical values are "about" or "approximately" the indicated value, and take into account experimental error and variations that would be expected by a person having ordinary skill in the art.

Various terms have been defined above. To the extent a term used in a claim is not defined above, it should be given the broadest definition persons in the pertinent art have given that term as reflected in at least one printed publication or issued patent. Furthermore, all patents, test procedures, and other documents cited in this application are fully incorporated by reference to the extent such disclosure is not inconsistent with this application and for all jurisdictions in which such incorporation is permitted.

While the foregoing is directed to embodiments of the present invention, other and further embodiments of the invention may be devised without departing from the basic scope thereof; and the scope thereof is determined by the claims that follow.

What is claimed is:

1. A system for producing anode grade coke comprising: a vacuum distillation tower, a hydroprocessing unit; a solvent deasphalting unit; and an anode coker; wherein feed to the anode coker comprises bottoms from the vacuum distillation tower, hydrotreated resid from the hydroprocessing unit, and a stream from the deasphalting unit, wherein at least a portion of the bottoms from the vacuum distillation tower are fed to the anode coker without passing through the hydroprocessing unit or the solvent deasphalting unit.

2. The system of claim 1, wherein feed to the solvent deasphalting unit comprises bottoms from the vacuum distillation tower.

3. The system of claim 1, further comprising an atmospheric distillation tower.

4. The system of claim 3, wherein feed to the hydroprocessing unit comprises bottoms from the atmospheric distillation tower.

5. The system of claim 3, wherein feed to the solvent deasphalting unit comprises bottoms from the atmospheric distillation tower.

6. The system of claim 1, wherein the solvent deasphalting unit comprises a residuum oil supercritical extraction process.

7. The system of claim 1, wherein the stream from the solvent deasphalting unit comprises a resins stream.

8. The system of claim 1, wherein the stream from the solvent deasphalting unit comprises a deasphalted oil stream.

9. The system of claim 1, wherein the stream from the solvent deasphalting unit comprises two or more of a deasphalted oil stream, a resins stream, and an asphaltene stream.

10. The system of claim 1, wherein the anode coker is configured to produce anode grade coke.

11. The system of claim 1, wherein the anode coker is configured to produce coke comprising less than 3 wt. % sulfur.

12. A method for producing anode grade coke, comprising:

blending a synthetic feed stream, the synthetic stream comprising hydrotreated resid, one or more streams from a solvent deasphalting unit, and vacuum distillation tower bottoms that are not hydrotreated or deasphaltized, and providing the synthetic feed stream to a coker unit.

13. The method of claim 12, wherein the hydrotreated resid comprises hydrotreated atmospheric distillation tower bottoms.

14. The method of claim 12, wherein the one or more streams from a solvent deasphalting unit comprises one or more resin streams.

15. The method of claim 12, wherein the one or more streams from a solvent deasphalting unit comprises deasphalted oil.

16. The method of claim 12, wherein the one or more streams from a solvent deasphalting unit comprises asphaltene.

17. The method of claim 12, wherein the one or more streams from a solvent deasphalting unit comprises at least of deasphalted oil, resins, and asphaltene.

18. The method of claim 12, wherein the anode anode grade coke comprises less than 3 wt. % sulfur.

19. The method of claim 12, wherein the solvent deasphalting unit comprises a residuum oil supercritical extraction process.

* * * * *